US006857139B2

(12) United States Patent
Walker

(10) Patent No.: US 6,857,139 B2
(45) Date of Patent: Feb. 22, 2005

(54) TACTILE THERAPY SYSTEM FOR SPAS

(75) Inventor: Victor Lee Walker, Murrieta, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/279,262

(22) Filed: Oct. 23, 2002

(65) Prior Publication Data

US 2004/0078885 A1 Apr. 29, 2004

(51) Int. Cl.[7] ..... A47K 3/10

(52) U.S. Cl. ..... 4/541.1; 4/538; 4/541.2; 4/541.3

(58) Field of Search ..... 4/538, 541.1, 541.2, 4/541.3

(56) References Cited

U.S. PATENT DOCUMENTS 3,744,483 A * 7/1973 Picolin ..... 601/28
4,173,216 A * 11/1979 Nolet ..... 601/59
5,158,073 A * 10/1992 Bukowski ..... 601/28
6,183,430 B1 * 2/2001 Lin ..... 601/168
D467,662 S * 12/2002 Leung et al. ..... D24/201
6,568,000 B1 * 5/2003 Kaufman et al. ..... 4/622
2002/0138930 A1 * 10/2002 Wheeler et al. ..... 15/110

* cited by examiner

*Primary Examiner*—Henry Bennett
*Assistant Examiner*—Amanda Wieker
(74) *Attorney, Agent, or Firm*—Fish & Richardson P.C.

(57) ABSTRACT

A tactile therapy system for use in a spa, hot tub, or pool. The tactile therapy system is based, at least in part, on the hand or foot maps specified in the reflexology art. The system thus includes a pattern of protrusions configured in accordance with reflexology hand map or foot map on which an individual may apply his or her hands or feet. The reflexology-based tactile therapy system may optionally be combined with hydrotherapy, by placing hydrotherapy jets among the pattern of protrusions.

15 Claims, 8 Drawing Sheets

FIG. 5
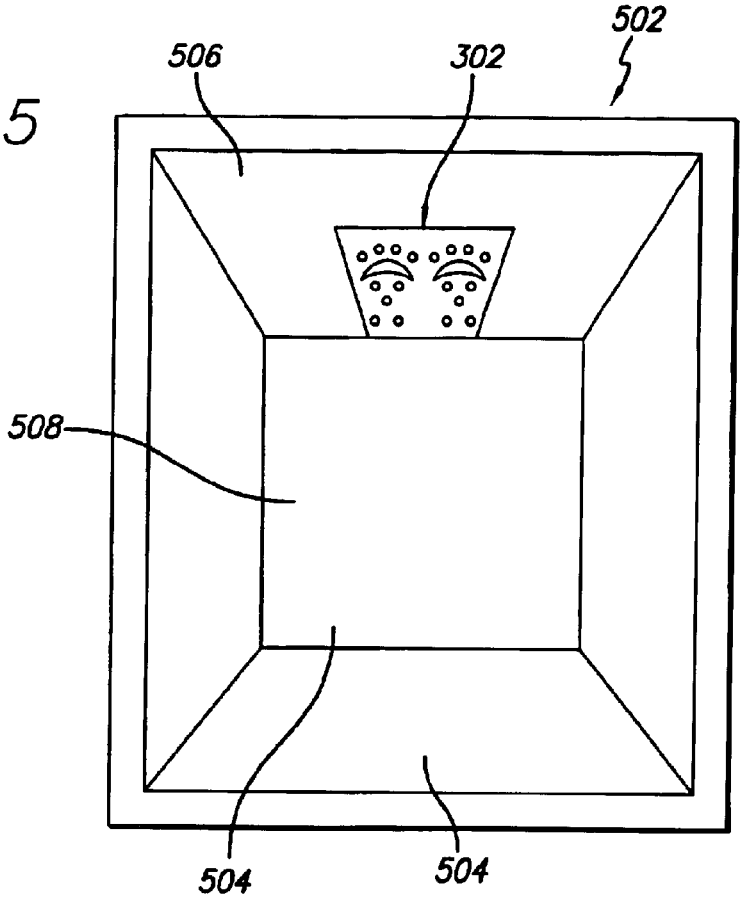
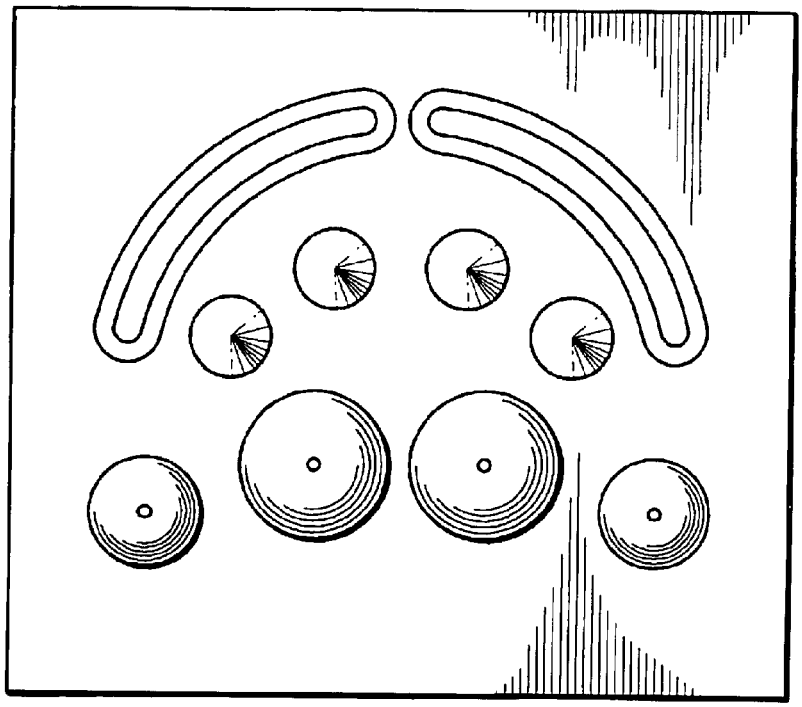
FIG. 6

FIG. 9
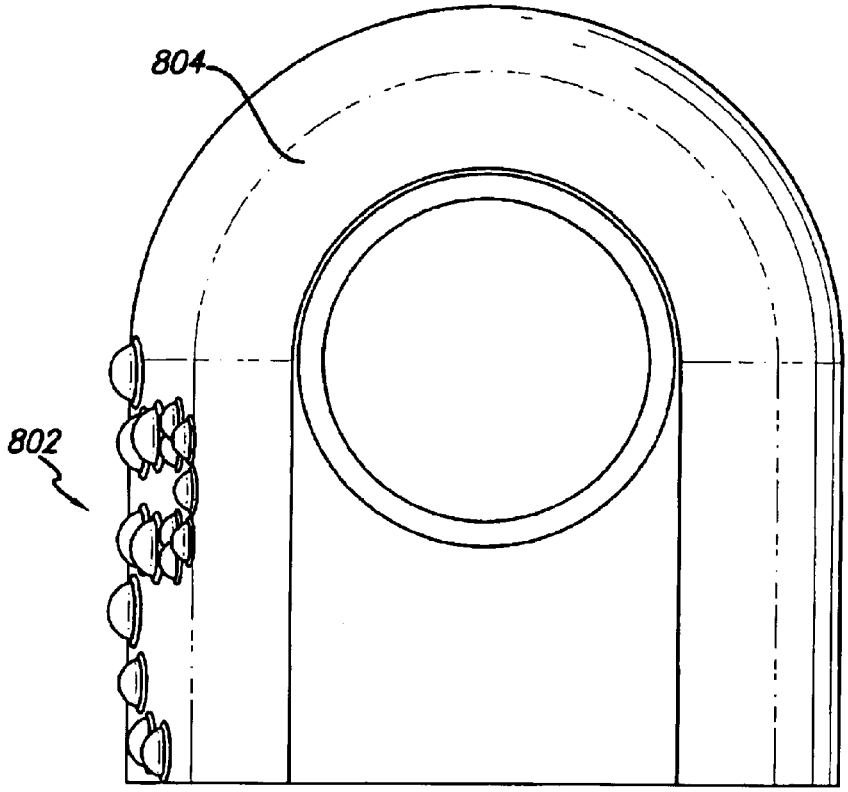
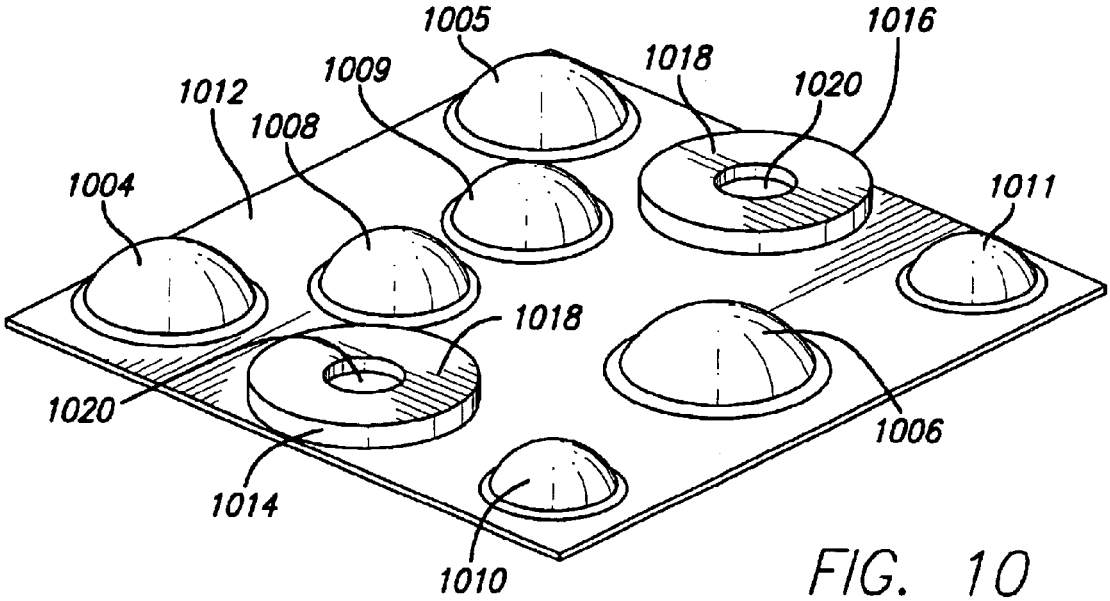
FIG. 10

FIG. 11
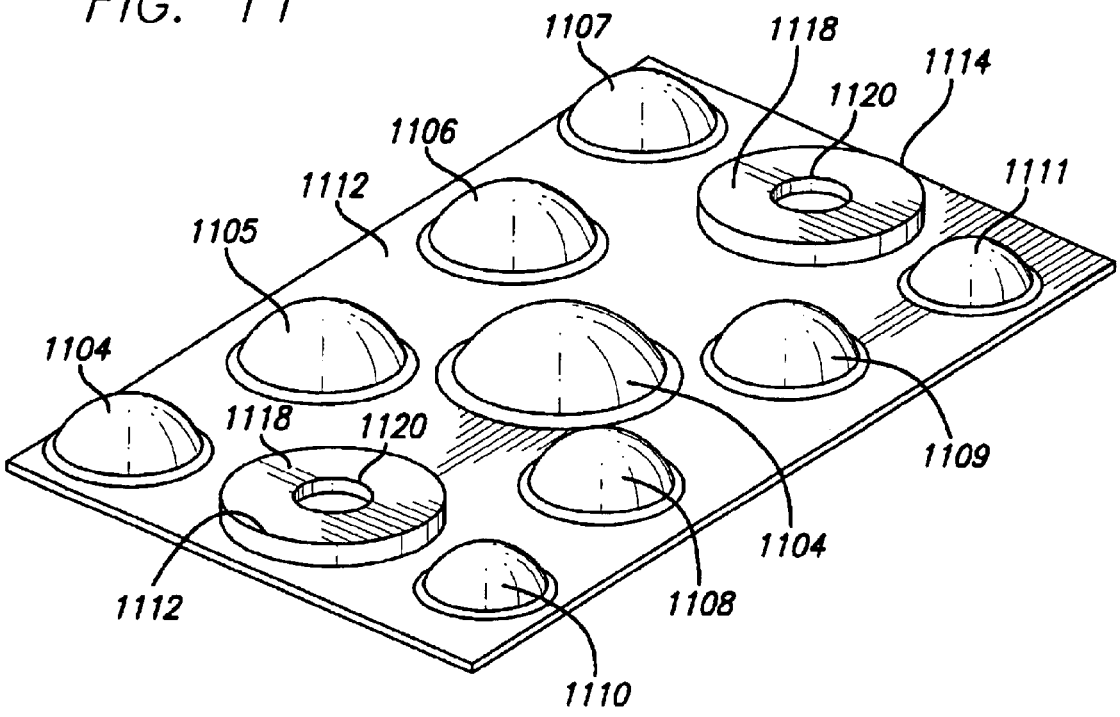
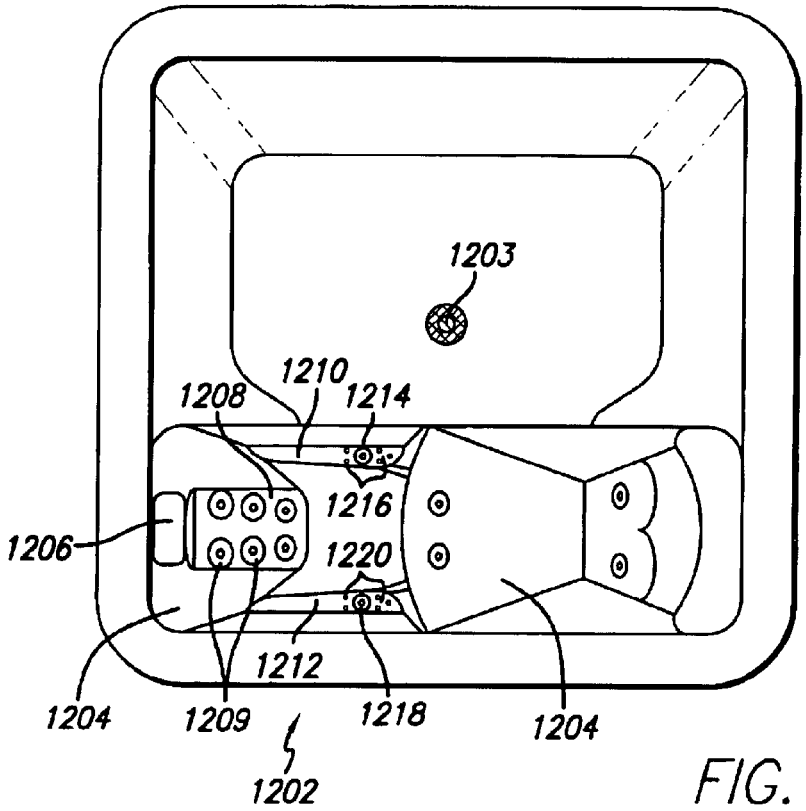
FIG. 12

TACTILE THERAPY SYSTEM FOR SPAS

TECHNICAL FIELD

This invention relates to a tactile therapy system for spas or hot tubs. More particularly, this invention relates to the provision of a pattern of protrusions based on reflexology hand and/or foot maps in a spa or hot tub.

BACKGROUND

Reflexology is the science or method of stimulating reflexes of the hand and foot that correspond to each gland, organ, and part of the body. The application of pressure at certain points or areas of the hand and foot may relieve tension and stress and improve circulation and natural functions in the related areas of the body. To specify these points and areas on the hand and foot, reflexology "maps" have been developed. FIG. 1 shows the reflexology map for the hand, while FIG. 2 shows the foot map. These maps, which outline therapeutic areas and relations inside the human body, are standardized and accepted by reflexology practitioners.

In accordance with the reflexology maps, a reflexology practitioner may apply pressure to the hands or feet in a particular mapped area to achieve therapeutic results in the corresponding gland, organ, or body part. Alternatively, a, pattern of raised bumps or protrusions, configured in accordance with the reflexology maps, may be formed on a substrate (e.g., plastic or fiberglass), and a person may rub his or her hands or feet on the pattern of protrusions to self-administer reflexology-based therapy. This is sometimes referred to as reflexology-based "tactile therapy."

In spas and hot tubs, warm water is used to provide a therapeutic effect. (For the remainder of their description, the term "spa" will be used to refer generally to spas and hot tubs.) Some spas also include "hydrotherapy" jets that emit a stream of pressurized water against a person's body for a massage-like therapeutic effect. The jets may be strategically located to apply hydrotherapy to the back, hands, feet, etc. However, conventional hydrotherapy and non-hydrotherapy spas have not included tactile therapy systems based on reflexology maps. Providing reflexology-based tactile therapy would add to the therapeutic benefits of spas.

Therefore, a need exists for a spa that includes a reflexology-based tactile therapy system, alone or in combination with hydrotherapy. The present invention provides such a spa.

SUMMARY

The present invention is, for example, a tactile therapy spa system, comprising a spa tub having an inner surface for holding water. The inner surface includes a plurality of protrusions arranged in a pattern that promotes reflexology-based therapy.

In another embodiment, the present invention is a tactile therapy spa system, comprising a spa tub having an inner surface for holding water. A plurality of protrusions are arranged in pattern based on a reflexology map, the plurality of protrusions extending from the inner surface of the spa tub to allow reflexology-based therapy.

In another embodiment, the present invention is a tactile therapy spa system, including: (1) a spa tub having an inner surface for holding water; (2) a plurality of protrusions arranged in a pattern based on a reflexology map, the plurality of protrusions extending from the inner surface of the spa tub to allow reflexology-based therapy; and (3) a plurality of hydrotherapy jets for emitting water, the jets being located among the plurality of protrusions.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 5 is a top view of a spa with a tactile therapy system in accordance with the present invention.

FIG. 6 is a top view of another exemplary pattern of protrusions in accordance with the reflexology foot map.

FIG. 9 is a top view of the pedestal mound shown in FIG. 8.

FIG. 10 is a perspective view of another exemplary pattern of protrusions, together with hydrotherapy jets, in accordance with the reflexology hand map.

FIG. 11 is a perspective view of yet another exemplary pattern of protrusions, together with hydrotherapy jets, in accordance with the reflexology hand map.

FIG. 12 is an overhead view of a spa shell, showing a massage chair with two arms, in which each arm has a hydrotherapy jet and a pattern of protrusions in accordance with the reflexology hand map.

DETAILED DESCRIPTION

In the following description, for purposes of explanation, numerous specific details are set forth in order to provide a thorough understanding of the present invention. It will be apparent, however, to one skilled in the art that the present invention may be practiced without these specific details.

Figure 1:
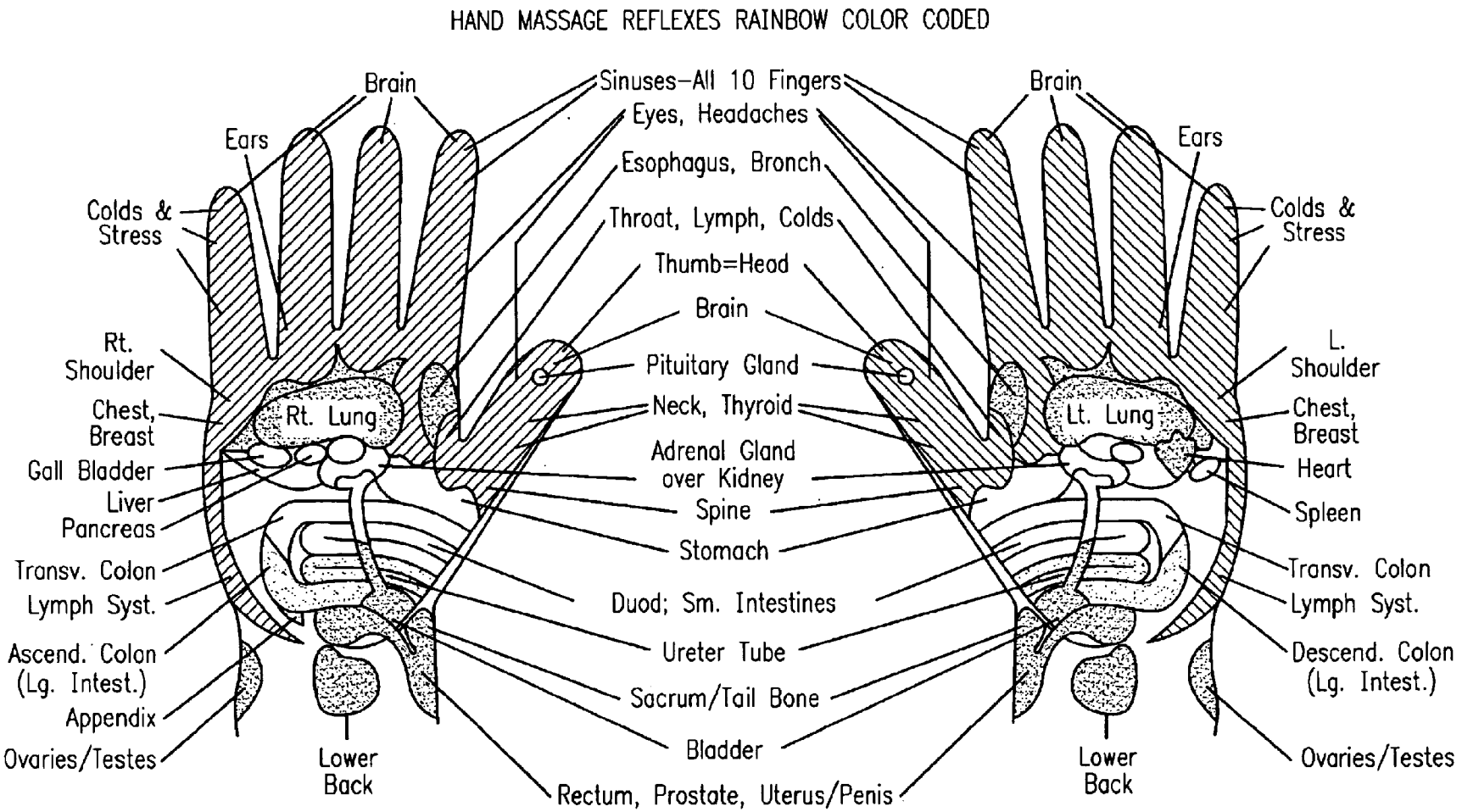
FIG. 1 is a reflexology map of the hands
Figure 2:
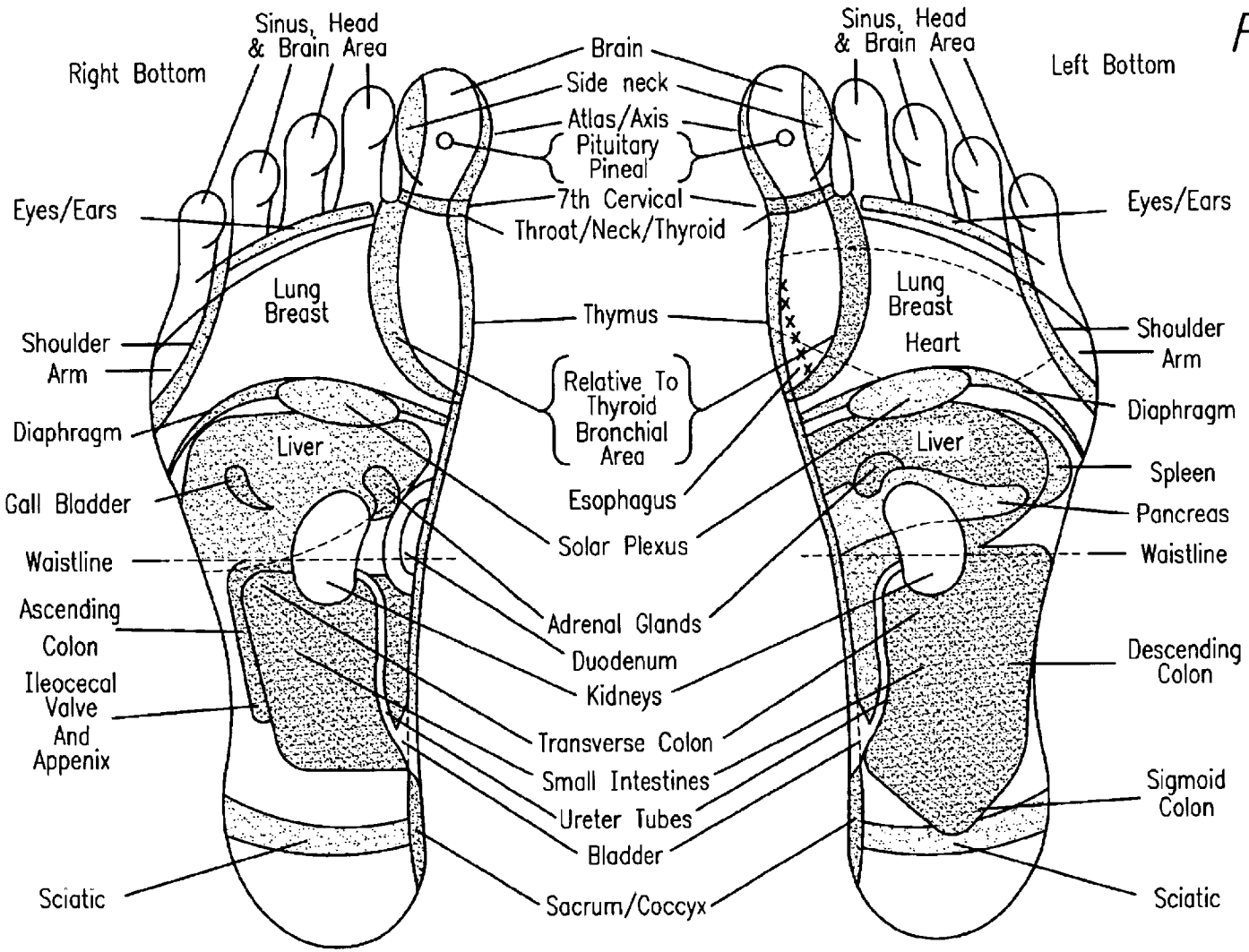
FIG. 2 is a reflexology map of the feet.
Figure 3:
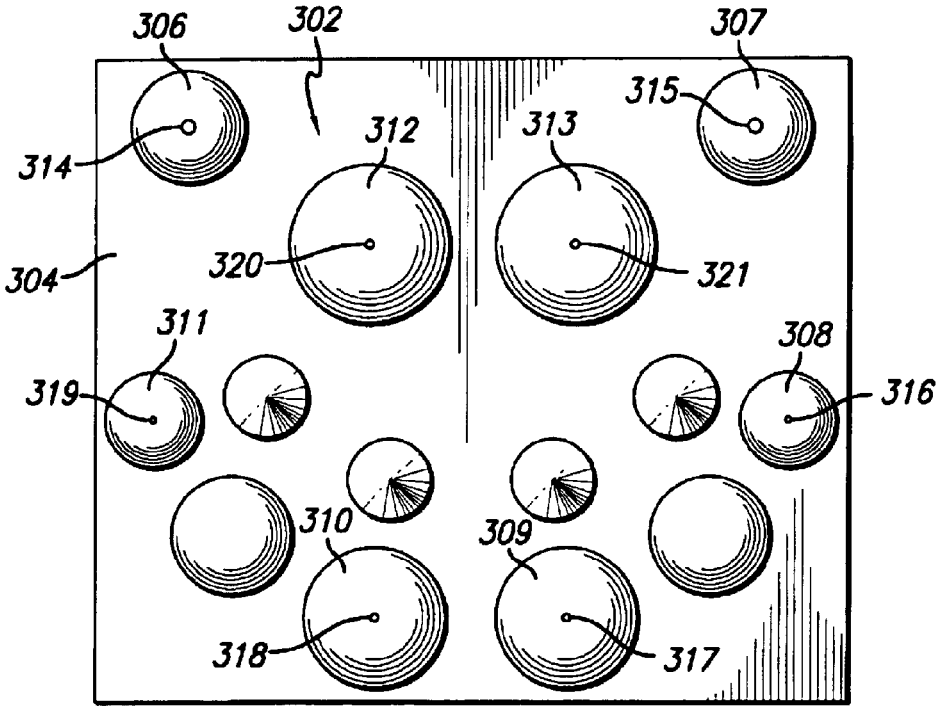
FIG. 3 is a top view of an exemplary pattern of protrusions in accordance with the reflexology foot map.
Figure 4:
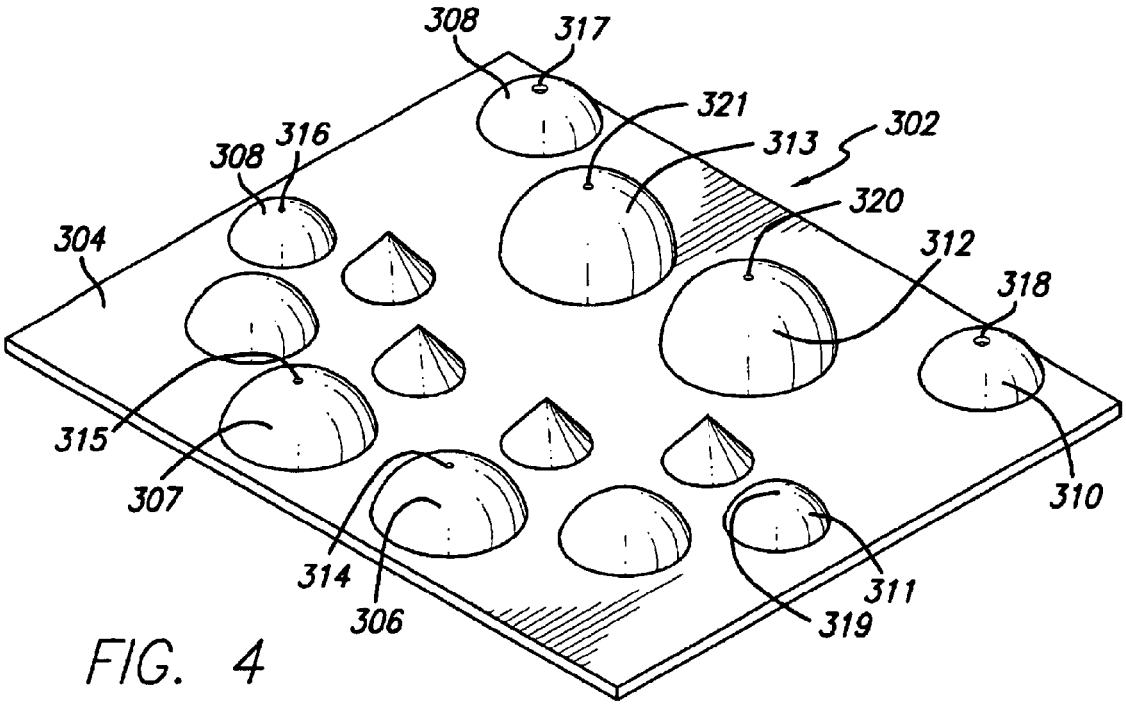
FIG. 4 is a perspective view of the pattern of protrusions shown in FIG. 3.
Figure 7:
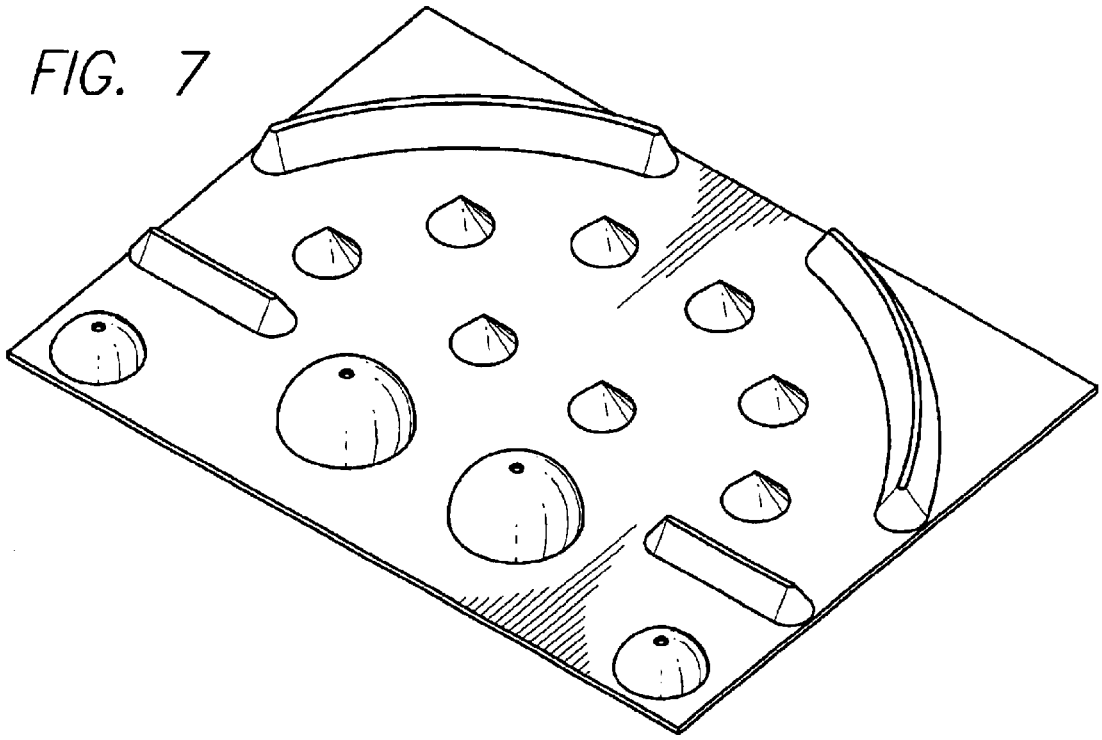
FIG. 7 is a perspective view of another exemplary pattern of protrusions in accordance with the reflexology foot map.

The reflexology hand and foot maps of FIGS. 1 and 2, respectively, lend themselves to many different tactile therapy systems in which patters of protrusions are formed in accordance with the reflexology maps. Such patterns of protrusions may be formed on a surface against which a person may rub his or her hands or feet to obtain a therapeutic effect. FIG. 3 shows an exemplary pattern of protrusions 302 formed on a surface 304 in accordance with the reflexology foot map of FIG. 2. FIG. 4 shows the pattern of protrusions 302 and the surface 304 from a perspective view. It will be appreciated that many different patterns of protrusions may be created and that the pattern shown in FIGS. 3 and 4 is merely exemplary. For example, FIGS. 6 and 7 show two additional examples of reflexology-based patterns. Moreover, patterns may be specifically formulated to address any one or a combination of the glands, organs, and body parts shown on the reflexology maps of FIGS. 1 and 2.

It will further be appreciated that the height, texture, and spacing of the protrusions is a matter of design choice.

In accordance with the present invention, and as shown in FIG. 5, which is a top view of a spa 502, the pattern of protrusions 302 may be formed on the inner surface 504 of the spa 502. As shown, the pattern of protrusions 302 are located on a wall 506 of the spa 502. Alternatively, the pattern of protrusions may be located on the floor 508 of the spa 502, or may be located on a pedestal mound (described in detail below) of the spa 502, or a footwell (not shown) formed in the floor 508 of the spa 502. Those skilled in the art will appreciate that the pattern of protrusions 502 may be located at any convenient place within the spa 502 that would allow a person to apply his or her feet (or hands, if the pattern is based on the reflexology hand map) comfortably and effectively to the pattern 302.

The pattern of protrusions 302 may be formed in the spa 502 in a variety of ways, in known fashion. For example, if the inner surface 504 is a fiberglass shell, the pattern of protrusions 302 may be integrally formed as part of the fiberglass shell, in any convenient location on the shell. Alternatively, a panel or substrate (such as the surface 304) may be provided that is separate from the inner surface 504, and this panel may be permanently or removably attached to the inner surface 504 at a convenient location. The means of attachment is a matter of design choice, including, for example, glue, screws, suction, or any other suitable means. As another alternative, and as will be shown and described in detail below, the pattern of protrusions 302 may be located on a pedestal mound of the spa 502. As yet another alternative, each protrusion may be a separate unit, and each such protrusion may be attached to the spa using, for example, glue. It will be appreciated that the protrusions may be made from any suitable material, including plastic, metal, or rubber.

Returning to FIGS. 3 and 4, the pattern of protrusions 302 includes several circular protrusions 306–313 with small openings 314–321 located at their centers. Each of these openings 314–321 represents the output of a hydrotherapy jet. Thus, hydrotherapy jets 314–321 may be combined with the tactile therapy system provided by the reflexology-based pattern of protrusions 302. It will be understood, however, that the present invention contemplates the use of reflexology-based tactile therapy either alone or in combination with hydrotherapy in a spa. The pattern of hydrotherapy jets 314–321 shown in FIGS. 3 and 4 is merely exemplary, and any convenient and effective pattern of hydrotherapy jets may be combined with a reflexology-based pattern of protrusions. Also, the hydrotherapy jets need not be located at the center of, or even on, a protrusion. Rather, hydrotherapy jets may be located off-center or even between protrusions. Thus, the hydrotherapy jets may be dispersed among the pattern of protrusions in any manner deemed suitable by the designer, with the aim being to place the jets strategically for therapeutic effect.

Figure 8:
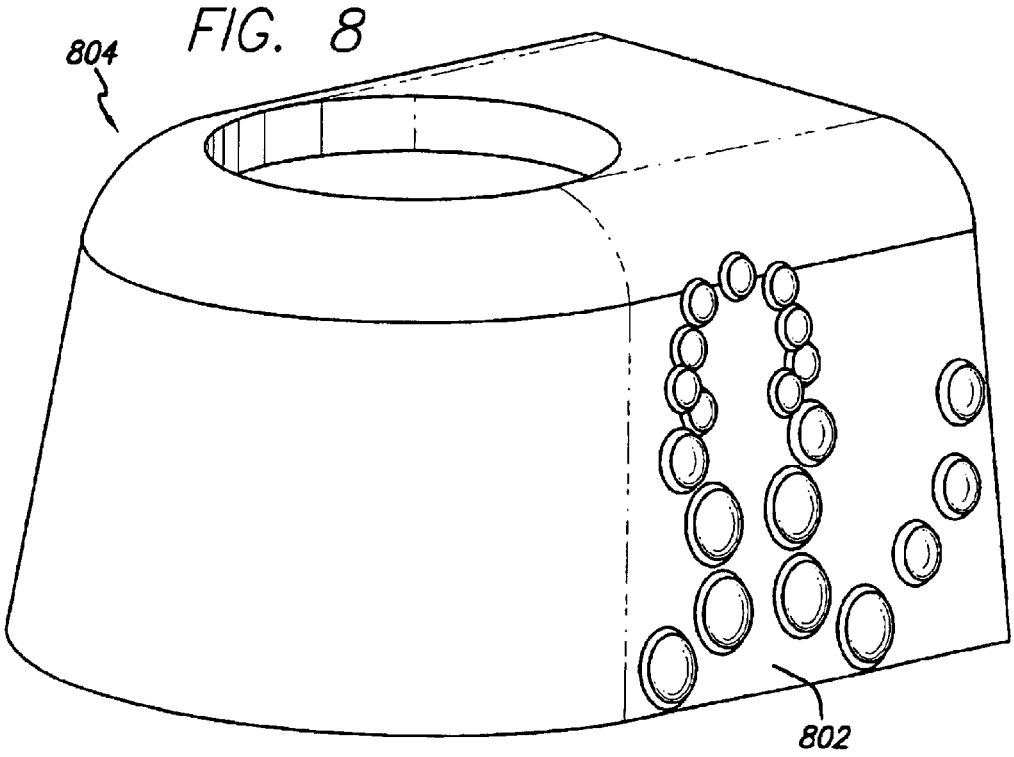
FIG. 8 is a perspective view of a pedestal mound for use in a spa, featuring an exemplary pattern of protrusions in accordance with the reflexology hand map.

As briefly described above, FIG. 8 shows a reflexology-based pattern of protrusions 802 integrally formed on a pedestal mound 804. FIG. 9 is a top view of the pedestal mound 804, showing the pattern of protrusions 802 from above. The pedestal mound 804 may be located, for example, on the floor of a spa, either in the center or against a wall. The location is a matter of design choice. The pedestal mound 804, shown in FIGS. 8 and 9, is designed to be mounted on the floor and against a wall of the spa. As those skilled in the art will appreciate, the pedestal mound 804 may be formed integrally as part of the inner surface of a spa, or may be a separate unit that is mounted to the inner surface, in known fashion. Moreover, as described above, the pattern of protrusions 802 may be integrally formed on the pedestal mound 802 (as shown) or may be attached by any suitable means. Finally, hydrotherapy jets (not shown) may be dispersed among the pattern of protrusions 802, as described above.

FIGS. 10 and 11 show two alternative embodiments of a pattern of protrusions 1002 and 1102, respectively, based on reflexology hand map of FIG. 1. In FIG. 10, the pattern of protrusions 1002 includes three larger protrusions 1004, 1005, and 1006, two mid-size protrusions 1008 and 1009, and two small protrusions 1010 and 1011. All of these protrusions are formed on a substrate 1012, as described in detail above. The substrate 1012 also includes two hydrotherapy jets 1014 and 1016, which are both formed separately from each of the protrusions. Each hydrotherapy jet 1014, 1016 may include a collar 1018 and a hole 1020 in the approximate center of the collar 1018. Hydrotherapy water is emitted through the hole 1020. The pattern of protrusions 1102 shown in FIG. 11 are formed on a substrate 1112 that includes one larger protrusion 1104, six medium size protrusions 1104, 1105, 1106, 1107, 1108, and 1109, and two smaller protrusions 1110 and 1111. Also included are two hydrotherapy jets 1114 and 1116, each of which has a collar 1118 and hole 1120 for emitting water.

FIG. 12 shows a spa 1202 with a drain 1203 at the bottom of the spa 1202 and a massage chair 1204 along one side of the spa 1202. The massage chair 1204 includes a back rest portion 1208 that includes multiple hydrotherapy jets 1209. In addition, the massage chair has two arm rests 1210 and 1212. Arm rest 1210 includes a hydrotherapy jet 1214 and a pattern of tactile therapy protrusions 1216 based on the reflexology hand map. Arm rest 1212 includes a hydrotherapy jet 1218 and a pattern of tactile therapy protrusions 1220 based on the reflexology hand map. Preferably, the hydrotherapy jets 1214 and 1218 are located within the pattern of protrusions 1216 and 1220, respectively, as shown. Those skilled in the art will recognize that a tactile therapy system could also be included for the feet in the massage chair 1204, such system based on the reflexology foot map and optionally including one or more hydrotherapy jets.

Figure 13A:
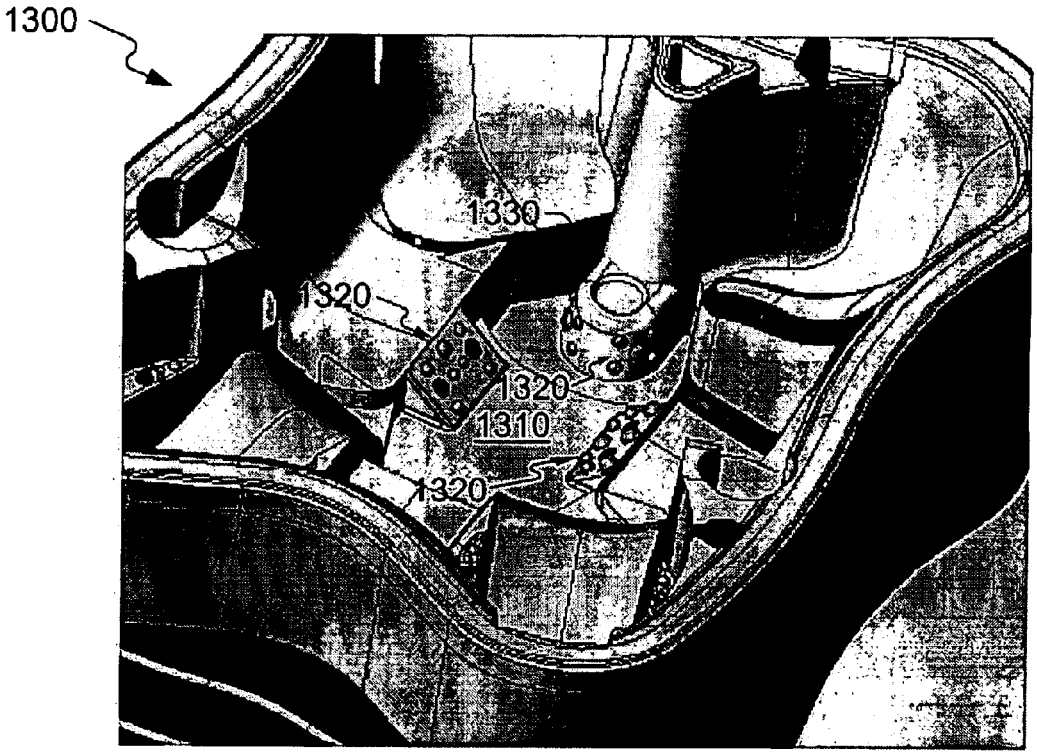
FIGS. 13A and 13B are perspective views of a spa, showing a foot well including multiple patterns of protrusions in accordance with reflexology maps and a pedestal.
Figure 13B:
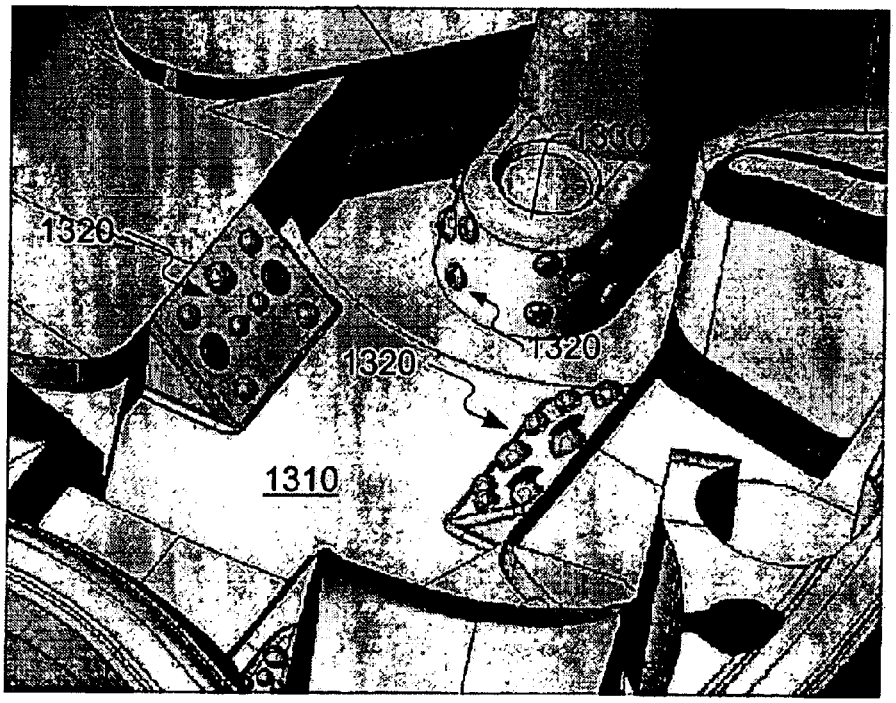

FIGS. 13A and 13B are perspective views of a spa 1300, showing a foot well 1310 including multiple patterns of protrusions 1320 in accordance with reflexology maps and a pedestal 1330.

A number of embodiments of the invention have been described. Nevertheless, it will be understood that various modifications may be made without departing from the spirit and scope of the invention. For example, a variety of patterns of protrusions may be provided based on either the reflexology hand map or foot map. In addition, a tactile therapy system based on the reflexology hand map or foot map may optionally incorporate hydrotherapy jets. Accordingly, other embodiments are within the scope of the following claims.

What is claimed is:

1. A tactile therapy spa system, comprising:

a spa tub having an inner surface for holding water;

the inner surface being of sufficient size to contain at least one person and including a plurality of protrusions arranged in a pattern that promotes reflexology-based therapy, the plurality of protrusions being of varied heights with respect to a region of the inner surface; wherein the inner surface has a floor, the floor includes a pedestal mound, and the plurality of protrusions protrude from the pedestal.

2. The tactile therapy spa system of claim 1, further comprising at least one hydrotherapy jet for emitting water, the hydrotherapy jet being located within the pattern of protrusions.

3. The tactile therapy spa system of claim 2 wherein the hydrotherapy jet is located within the periphery of one of the plurality of protrusions.

4. The tactile therapy spa system of claim 1, further comprising a plurality of hydrotherapy jets for emitting water, the plurality of hydrotherapy jets being located among the plurality of protrusions.

5. The tactile therapy spa system of claim 4 wherein at least one of the plurality of hydrotherapy jets is located within the periphery of one of the plurality of protrusions.

6. A tactile therapy spa system, comprising:

a spa tub having an inner surface for holding water; and a plurality of protrusions arranged in pattern based on a reflexology map, the plurality of protrusions extending from the inner surface of the spa tub to allow reflexology-based therapy, the plurality of protrusions being of varied heights with respect to a region of the inner surface and the inner surface being of sufficient size to contain at least one person, wherein the inner surface includes a pedestal mound, and wherein the plurality of protrusions are located on the pedestal mound.

7. The tactile therapy spa system of claim 6, further comprising: a plurality of hydrotherapy jets disposed among the plurality of protrusions.

8. The tactile therapy system of claim 6, further comprising a plurality of hydrotherapy jets for emitting water, the plurality of hydrotherapy jets being located among the plurality of protrusions.

9. The tactile therapy system of claim 6 wherein the pattern of the plurality of protrusions is based on the standard reflexology foot map.

10. The tactile therapy system of claim 6, further comprising a plurality of hydrotherapy jets for emitting water, the plurality of hydrotherapy jets being located among the plurality of protrusions.

11. A tactile therapy spa system, comprising:

a spa tub having an inner surface for holding water;

a plurality of protrusions arranged in pattern based on a reflexology map, the plurality of protrusions extending from the inner surface of the spa tub to allow reflexology-based therapy, the plurality of protrusions being of varied heights with respect to a region of the inner surface and the inner surface being of sufficient size to contain at least one person; and a plurality of hydrotherapy jets for emitting water, the plurality of hydrotherapy jets being located among the plurality of protrusion, wherein the inner surface includes a pedestal mound, and wherein the plurality of protrusions are located on the pedestal mound.

12. A spa system comprising:

a spa tub including a spa shell of sufficient size to contain at least one person, the spa shell comprising a plurality of protrusions arranged in a pattern that promotes reflexology-based therapy, the plurality of protrusions being of varied heights; and at least one hydrotherapy jet located within one of the plurality of protrusions, wherein the spa shell includes a pedestal mound, and wherein the plurality of protrusions are located on the pedestal mound.

13. The spa system of claim 12, further comprising one or more additional hydrotherapy jets located among the plurality of protrusions.

14. The tactile therapy system of claim 11 wherein the pattern of the plurality of protrusions is based on the standard reflexology foot map.

15. The tactile therapy system of claim 12 wherein the pattern of the plurality of protrusions is based on the standard reflexology foot map.

* * * * *